US011661835B2

(12) United States Patent
Gariépy et al.

(10) Patent No.: US 11,661,835 B2
(45) Date of Patent: May 30, 2023

(54) SYSTEMS, APPARATUSES, AND METHODS FOR AUTOMATED CONTROL OF BLASTHOLE DRILL BASED ON PERFORMANCE MONITORING

(71) Applicant: Peck Tech Consulting Ltd., Montreal (CA)

(72) Inventors: François Gariépy, Saint-Colomban (CA); Jonathan Peck, Magog (CA)

(73) Assignee: Peck Tech Consulting Ltd., Quebec (CA)

( * ) Notice: Subject to any disclaimer, the term of this patent is extended or adjusted under 35 U.S.C. 154(b) by 246 days.

(21) Appl. No.: 17/109,199

(22) Filed: Dec. 2, 2020

(65) Prior Publication Data

US 2021/0164335 A1 Jun. 3, 2021

Related U.S. Application Data

(60) Provisional application No. 62/943,020, filed on Dec. 3, 2019.

(51) Int. Cl.
*E21B 44/02* (2006.01)
*E21B 45/00* (2006.01)
(Continued)

(52) U.S. Cl.
CPC ..... *E21B 44/02* (2013.01); *E21B 7/025* (2013.01); *E21B 45/00* (2013.01); *E21B 49/00* (2013.01); *E21B 10/08* (2013.01); *E21B 2200/22* (2020.05)

(58) Field of Classification Search
CPC ..... E21B 44/02; E21B 7/025; E21B 45/00; E21B 2200/22
See application file for complete search history.

(56) References Cited

U.S. PATENT DOCUMENTS 5,358,058 A 10/1994 Edlund
5,449,047 A 9/1995 Schivley, Jr.
(Continued)

FOREIGN PATENT DOCUMENTS

CN 104215649 A 12/2014
WO 95/09294 A1 4/1995

OTHER PUBLICATIONS

Hamrick, Todd Robert, "Optimization of Operating Parameters for Minimum Mechanical Specific Energy in Drilling", College of Engineering and Mineral Resources Department of Mechanical and Aerospace Engineering at West Virginia University, 2011, pp. 10, [online] [retrieved on Dec. 16, 2020 (Dec. 16, 2020)].

*Primary Examiner* — Tara Schimpf
(74) *Attorney, Agent, or Firm* — Xsensus, L.L.P.

(57) ABSTRACT

An advanced real-time drilling control system can comprise circuitry configured to continuously monitor, in real time, drilling performance of an electric drilling machine as the electric drilling machine drills a blasthole using a rotary tricone drill bit. The continuous monitoring can include continuously collecting, according to a predetermined sampling rate, drill performance data from one or more sensors of the electric drilling machine in real time. The circuitry can also be configured to adjust, in real time, pulldown pressure/rate and rotary speed of the rotary tricone drill bit of the electric drilling machine to optimize penetration rate of the rotary tricone drill bit based on the drill performance data and output of one or more machine learning operations applied to the drill performance data.

17 Claims, 4 Drawing Sheets

(51) Int. Cl.

| | |
|---|---|
| ***E21B 49/00*** | (2006.01) |
| ***E21B 7/02*** | (2006.01) |
| *E21B 10/08* | (2006.01) |

(56) References Cited

U.S. PATENT DOCUMENTS

| | | | | |
|---|---|---|---|---|
| 5,842,149 | A | 11/1998 | Harrell et al. | |
| 2010/0108384 | A1 | 5/2010 | Byreddy et al. | |
| 2012/0323495 | A1 | 12/2012 | Zhou | |
| 2018/0216451 | A1* | 8/2018 | Huikkola | E21B 44/00 |
| 2019/0048705 | A1* | 2/2019 | McHugh | E21B 7/02 |
| 2020/0040720 | A1* | 2/2020 | Zalluhoglu | E21B 7/04 |
| 2021/0025269 | A1* | 1/2021 | Zaripov | E21B 7/04 |

* cited by examiner

SYSTEMS, APPARATUSES, AND METHODS FOR AUTOMATED CONTROL OF BLASTHOLE DRILL BASED ON PERFORMANCE MONITORING

CROSS-REFERENCE TO RELATED APPLICATION(S)

This application claims the benefit under 35 U.S.C. § 119(e) of U.S. Provisional App. No. 62/943,020, filed Dec. 3, 2019, wherein the entire content and disclosure of which is hereby incorporated by reference herein in its entirety.

TECHNICAL FIELD

The present disclosure relates to control of blasthole drills, and more particularly to systems, apparatuses, and methods for automated control of an electrically powered blasthole drill based on performance monitoring of the blasthole drill when drilling a vertical blasthole in a geological rock mass.

BACKGROUND

To viably extract commercially exploitable material (e.g., ore material) in a mine (e.g., an open pit mine) it can be desirable or even necessary to drill vertical (or inclined) blastholes in a time efficient manner while also minimizing any negative impact of variations that can be introduced by a human operator. Typical drilling in a mine where a rotary tricone drill bit is used results in crushing, fracturing, and/or breakage (failure) of intact rock through a combination of vertically (or substantially vertical) applied pulldown pressure (or weight on bit) and tangential energy generated through rotation of the rotary tricone drill bit resulting in a progressive increase in blasthole length/depth. To achieve efficient and effective blasthole drilling, it is necessary for the human operator to constantly monitor and control both the applied pulldown pressure/rate and rotary speed to ensure maximum penetration rate while minimizing the generation of excessive rotary torque and vibrations that can result in unacceptable machine wear/tear. However, in a typical mining operation, the skill, experience, and thus capabilities of human operators to provide efficient and consistent manual control of applied pulldown pressure/rate and rotary speed under various operational conditions (e.g., variable geology, wearing machine and components) can result in unsatisfactory machine performance variability, which can thus increase costs of operations and/or reduce efficiency or productivity. This can result in most operators simply maintaining a fixed rotation speed to mainly focus on making adjustments to the pulldown pressure/rate as the drilling conditions change.

Additionally, conventional drilling approaches may be based on maintaining a fixed ratio between the penetration rate and rotation speed, i.e., seeking to maintain a constant Depth of Cut ("DoC") value at all times through adjustment to the hoist/pulldown force and rotation speed. DoC is a concept that specifically relates to the design of a rotary tricone drill bit and how the rotary tricone drill bit penetrates, fractures, and breaks intact rock at the bit-rock interface in a blasthole. DoC may be characterized, basically, as the unit amount of broken rock that is generated for each rotation of a rotary tricone drill bit under axial load and can be calculated by dividing the current penetration rate by the rotation speed. DoC can be highly specific to the make, model, and design of each rotary tricone drill bit in relation to the length of the inserts (teeth) (e.g., tungsten-carbide inserts (teeth)) that are deployed on each of the three (3) cones that comprise the rotary tricone drill bit. A general rule is that shorter inserts are used for rotary tricone drill bits for drilling harder (brittle) rocks that tend to break (fail) under axial (compressive) loads versus those forces induced through rotation energy (tangential). For softer (ductile) rocks, rotary tricone drill bits with longer inserts are used to allow deeper penetration and failure due to primarily rotational forces while under an axial load.

It was theoretically determined that this approach may maximize the rate of penetration, and the hypothetical approach of minimizing rotary tricone drill bit rotation while maximizing penetration rate (subject to various constraints, including the ability to quickly remove the broken rock fragments (cuttings) from the bit-rock interface to prevent regrinding by the rotary tricone drill bit) would be more efficient. In this regard, it is known that excessive rotation speeds can accelerate rotary tricone drill bit wear while also wasting generated energy and leading to regrinding of the cuttings, which may make the cuttings finer and thus harder to efficiently remove from the blasthole. Additionally, the approach assumes that the maximum depth at which the inserts can penetrate intact rock and propagate fractures is solely a function of their length, shape, and spacing as well as the characteristics of the rock materials being drilled. As a result, the approach suggests that if the process of rock breakage at the bit-rock interface is steady-state, it is possible to execute drilling control based on a predetermined and fixed DoC, or "depth of rock fracturing per bit rotation" for any given rotary tricone drill bit. However, in practice, rock breakage using a rotary tricone drill bit can be far from steady-state due to the multivariate and dynamic processes that are in fact occurring at the bit-rock interface.

U.S. Pat. No. 5,449,047 ("the '047 patent") describes automatic control of a drilling system. In particular, a blasthole drill is provided with sensors for sensing the pressure (AP) applied to and through a rotary tricone drill bit to convey cuttings from the drill hole, the rate of rotation (N) of the rotary tricone drill bit, the torque (RT) required to rotate the rotary tricone drill bit, the force (FB) applied axially to the rotary tricone drill bit, and the instantaneous vertical position (Y) of the rotary tricone drill bit. The signals from the sensor are used to compute the penetration of the rotary tricone drill bit per revolution of the rotary tricone drill bit (P/R) and the rock specific fracture energy (Es). The sensed values and the computed values are used to produce output signals to increment/decrement the force (FB) applied axially to the drill. According to the '047 patent, the applied axial force is controlled such that the penetration of the rotary tricone drill bit per revolution remains substantially constant for a given range of values of the rock specific fracture energy but varies for different ranges of the rock specific fracture energy, where the rate or rotation of the rotary tricone drill bit is controlled to a pre-set reference value.

SUMMARY

In one aspect, an advanced real-time drilling control system is disclosed. The system can comprise a real-time control sub-system including an embedded computing platform, programmable logic controller, and embedded software. The real-time control sub-system can be configured to continuously monitor, in real time, drilling performance of an electric drilling machine as the electric drilling machine drills a blasthole using a rotary tricone drill bit. The continuous monitoring can include continuously collecting, according to a predetermined sampling rate, drill performance data from one or more sensors of the electric drilling machine in real time. The real-time control sub-system can also be configured to adjust, in real time, pulldown pressure/rate and rotary speed of the rotary tricone drill bit of the electric drilling machine to optimize penetration rate of the rotary tricone drill bit based on the drill performance data and output of one or more machine learning operations applied to the drill performance data.

In another aspect, an automatic drilling control method is disclosed. The method can comprise receiving, in real time, at drill control interface circuitry, monitor-while-drilling (MWD) signals from one or more sensors of an electric drilling machine at a predetermined sampling rate as the electric drilling machine drills a blasthole; and maintaining, using the drill control interface circuitry, penetration rate of a rotary tricone drill bit of the electric drilling machine to within a predetermined optimization range specific to a rock mass with particular characteristics for each of a plurality of varying depth as the electric drilling machine drills the blasthole. The maintaining of the penetration rate can include controlling, in real time, pulldown pressure/rate and rotary speed of the rotary tricone drill bit based on processing of the monitor-while-drilling (MWD) signals from one or more sensors. The sampling rate for the monitor-while-drilling (MWD) signals can be greater than a rate to control the pulldown pressure/rate and rotary speed of the rotary tricone drill bit in real time.

And in another aspect, a non-transitory computer-readable storage medium storing computer-readable instructions that, when executed by one or more computers or processors, causes the one or more computers or processors to perform a drilling control method, is disclosed. The drilling control method can comprise receiving, in real time, monitor-while-drilling (MWD) signals from one or more sensors of an electric drilling machine at a predetermined sampling rate as the electric drilling machine drills a blasthole; and maintaining penetration rate of a rotary tricone drill bit of the electric drilling machine to within a predetermined optimization range specific to a rock mass with particular characteristics at varying depths in the blasthole as the electric drilling machine drills the blasthole. The maintaining of the penetration rate can include controlling, in real time, pulldown pressure/rate and rotary speed of the rotary tricone drill bit based on processing of the monitor-while-drilling (MWD) signals from one or more sensors. The sampling rate for the monitor-while-drilling (MWD) signals can be greater than a rate to control the pulldown pressure/rate and rotary speed of the rotary tricone drill bit in real time.

Other features and aspects of this disclosure will be apparent from the following description and the accompanying drawings.

DETAILED DESCRIPTION

Embodiments of the disclosed subject matter involve automated drilling control of an electrically powered blasthole drill based on performance monitoring of the blasthole drill when drilling a vertical blasthole in a geological rock mass. The blasthole can be loaded with explosives that, once detonated, can create broken rock material. The broken rock material, when collected, transported, and processed, can enable the commercially viable extraction of ore minerals into finished products.

Figure 1:
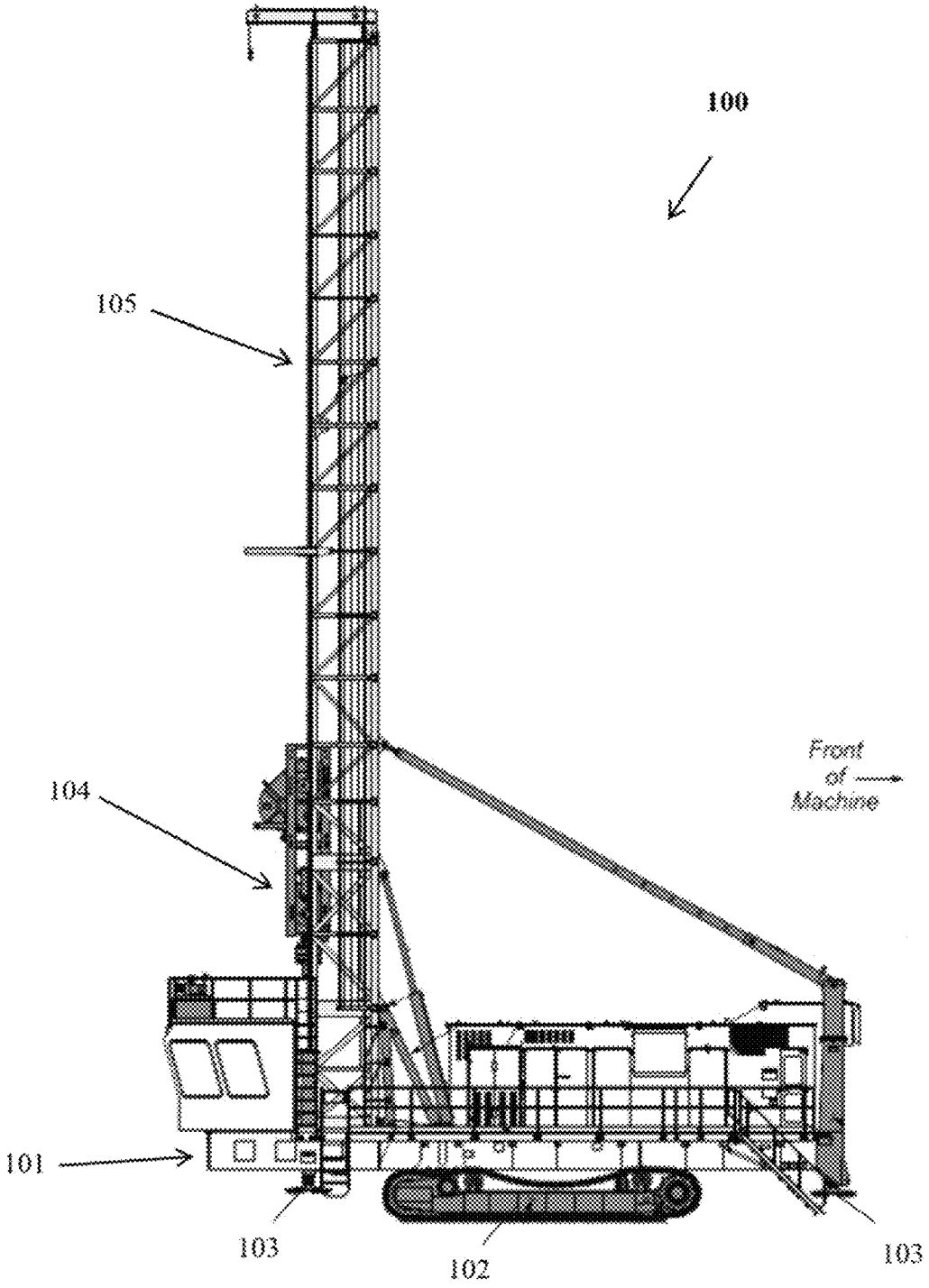
FIG. 1 shows a side view of an electrically powered blasthole drilling machine according to one or more embodiments of the disclosed subject matter.
Figure 2:
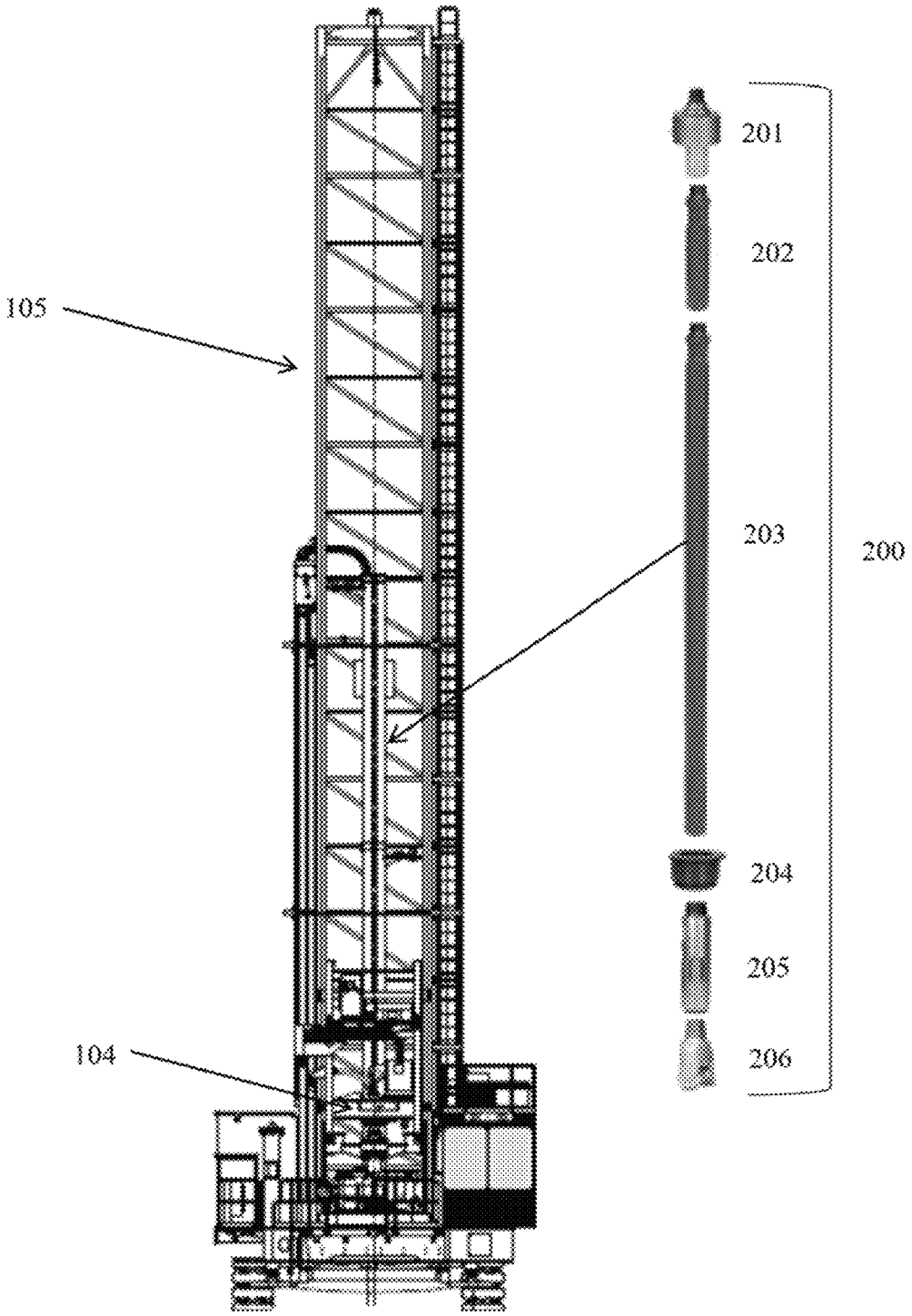
FIG. 2 shows an end view of the electrically powered blasthole drilling machine of FIG. 1 with an exploded view of the drill string assembly.

FIG. 1 and FIG. 2 show representations of an electric drilling machine 100 according to embodiments of the disclosed subject matter. The electric drilling machine 100 may also be referred to as an electrically powered blasthole drilling machine.

Generally, the electric drilling machine 100 can be used to drill a hole into intact rock using a rotary tricone drill bit 206. The hole may be referred to as a blasthole and may be filled with explosive and non-explosive materials for the purpose of fragmenting and breaking intact rock material in the vicinity of the hole. The positioning of the explosive materials in the blasthole may be selective in nature, for instance, to achieve the required blast outcome (e.g., rock fragmentation size distribution, vertical and horizontal blast movements, and/or muckpile diggability).

The electric drilling machine 100 can be comprised of a frame or chassis 101 provided on a crawler traction system 102, such as a set of tracks, to move the electric drilling machine 100. The electric drilling machine 100 can also have a set of four (4) of leveling jacks 103 that can be individually adjusted to level (e.g., make horizontal) the frame or chassis 101 prior to the start of drilling to create a vertical blasthole.

The electric drilling machine 100 can have a drill mast or tower 105 operatively coupled to the frame or chassis 101, which can be used to support (including raise and lower) a drill string assembly 200. The drill string assembly 200 can be comprised of a drill pipe 203 and optionally a drill pipe extender 202. A rotary tricone drill bit 206 can be connected to the bottom end of the drill string assembly 200, and the drill string assembly 200 can be connected to a rotary drill head 104 of the electric drilling machine 100 (note that in FIG. 1 the rotary drill head 104 is lower along the drill tower 105, which may represent the rotary tricone drill bit 206 and a portion of the drill pipe 203 being in an underlying blasthole).

The drill string assembly 200 can rotate through a deck bushing 204 to align and guide the drill pipe 203. An optional shock sub 201 may be added to the drill string assembly 200 to absorb axial and transverse vibrations generated by the rotation of the drill string assembly 200 and rock breakage mechanisms at the interface between the intact rock and the rotary tricone drill bit 206. The drill string assembly 200 may also include a drill bit stabilizer 205 between the rotary tricone drill bit 206 and drill pipe 203 to stabilize rotation of the rotary tricone drill bit 206.

Generally, the rotary drill head 104 can apply pulldown pressure and rotate the drill string assembly 200 based on operation of one or more electric motors operatively coupled to or as part of the rotary drill head 104 and drill tower 105 assembly. In this regard, the electric drilling machine 100 can control the drill string assembly 200 to rotate so as to progressively break the intact rock material using the rotary tricone drill bit 206 attached to the end of the drill string assembly 200 while under an applied axial (vertical) load.

Figure 3:
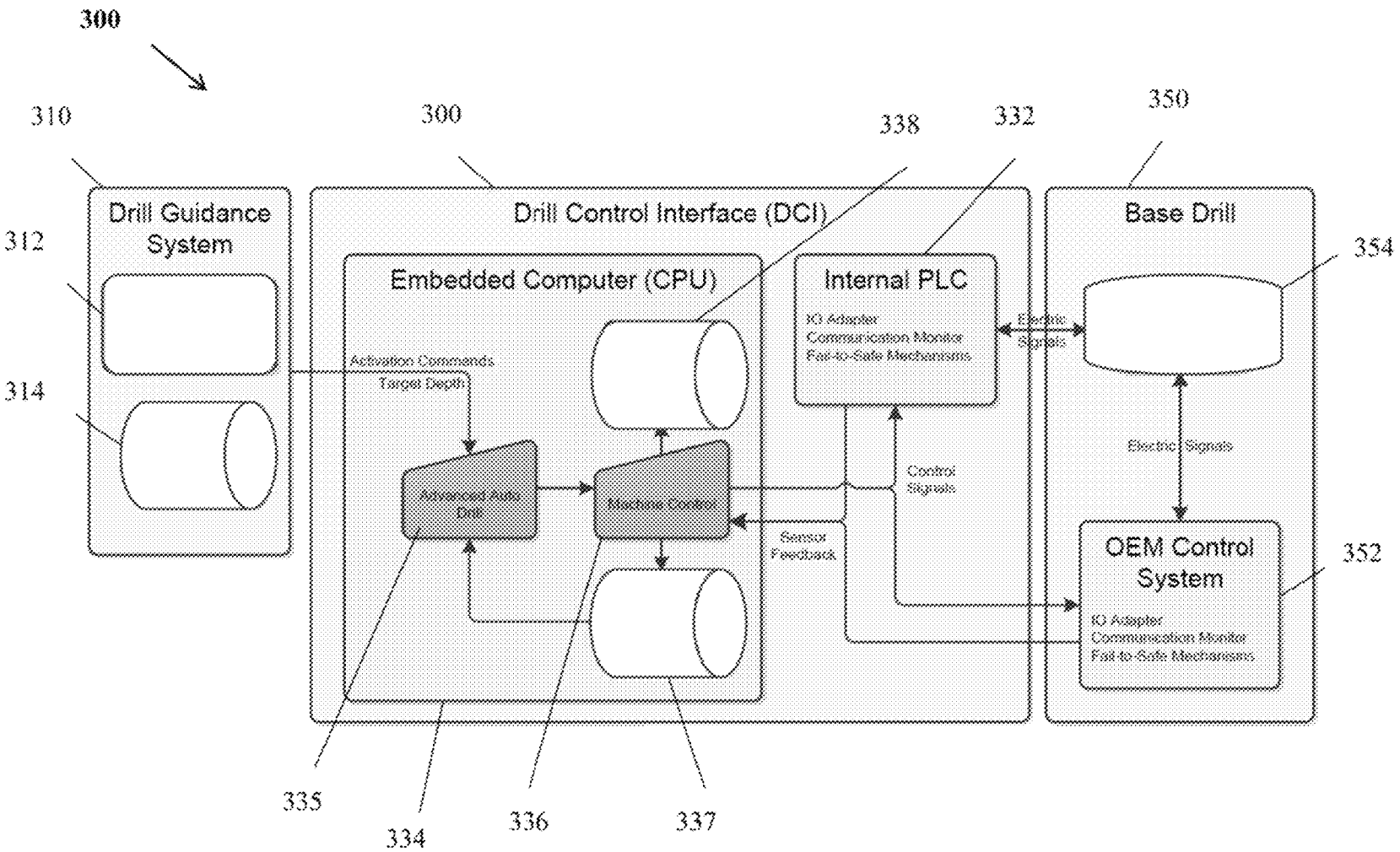
FIG. 3 is a block diagram of a system according to one or more embodiments of the disclosed subject matter.

Turning to FIG. 3, FIG. 3 shows a system 300 according to one or more embodiments of the disclosed subject matter. System 300, which can be implemented in electric drilling machine 100, can be comprised of a drill guidance system or module 310, a drill control interface system or module 330, and a drill system or module 350. Embodiments of the disclosed subject matter can be directed to some or all of the system 300, such as the drill control interface module 330 alone or the drill control interface module 330 in combination with the drill guidance module 310 and/or the drill system 350. According to one or more embodiments, the drill guidance module 310 and/or the drill system 350 can be interfaced with the drill control interface module 330 as a so-called add-on, which can provide the drill control interface module 330 the capability to interface and interact with the existing drill guidance module 310 and/or drill system 350 of the electric drilling machine 100 via electrical signaling to and from the drill control interface module 330 relative to the existing drill guidance module 310 and/or drill system 350 of the electric drilling machine 100, such as shown in FIG. 3.

The drill guidance module 310 can include a user interface 312 and storage 314 in the form of electronically accessible, computer-readable memory, for instance. The user interface 312 can receive operator inputs to provide a drilling plan or plans for the electric drilling machine 100 for drilling of one or more blastholes. Such drilling plan(s) can be saved in the storage 314 for later retrieval and supply to the drill control interface module 330 to perform drilling operations, particularly when implementing a drilling control methodology according to embodiments of the disclosed subject matter. Drilling plan(s) can include characteristics of the to-be-drilled blasthole, such as target depth. The user interface 312 can also receive operator input(s) to start (and stop) the automated drilling control of the drill control interface module 330. The drilling plan data and the drilling start/stop commands can be received directly by the drill control interface module 330, such as shown in FIG. 3.

System 300 can, implementing the drilling control methodology (e.g., hardware and/or software that can operate to implement a drilling control algorithm), determine a need to adjust applied pulldown pressure/rate and rotary speed of the electric drilling machine 100 based on feedback data acquired by the drill system 350 from one or more monitoring or monitorable components 354 of the electric drilling machine 100, and adjust the applied pulldown pressure/rate and rotary speed of the electric drilling machine 100 under control of the drill control interface module 330 based on the feedback data. Examples of such components 354 can include one or more sensor(s), actuator(s) (e.g., electronically controlled), motor(s), valve(s) (e.g., electronically controlled), etc. of the electric drilling machine 100 that are operational during the drilling operation of the electric drilling machine 100. As noted above, operation of the electric drilling machine 100 can produce electrical outputs from or associated with the one or more monitoring or monitorable components 354 of the electric drilling machine 100. Such electrical outputs can be in the form of electrical signaling and provided to the drill control interface module 330. As shown in FIG. 3, such feedback can be provided directly to the drill control interface module 330 and/or indirectly via the control module 352.

The drill system 350 can include or otherwise interface with one or more sensors of the one or more monitoring or monitorable components 354 of the electric drilling machine 100. Such one or more sensors can include sensor(s) adapted to sense or measure operating characteristics or parameters of the electric drilling machine 100 during a drilling operation of the electric drilling machine 100. For instance, such sensor(s) can sense or detect one or more of rotary speed (e.g., in rpms), rotary torque (TRQ) (or electric current), pull down hoist/pulldown speed, hoist/pulldown force (or electric current), bit air pressure, penetration rate, horizontal vibrations, and/or vertical vibrations. In one or more embodiments, some or all of the sensor(s) can sense voltage and/or current of one or more electric motors adapted to drive the drill string assembly 200 (and rotary tricone drill bit 206), particularly in the case of an all-electric electric drilling machine 100. Some or all of the signals from the sensor(s) may be characterized as Monitor-While-Drilling (MWD) signals. Data pertaining directly and/or indirectly from the MWD signals may be referred to as drill performance data. Discussed in more detail below, at least some of the data can be representative of or otherwise used to determine specific energy and penetration rate as the electric drilling machine 100 drills the blasthole. Regarding the foregoing, the outputs from the sensor(s) can be provided directly to the drill control interface module 330 or indirectly via a control module 352 of the drill system 350, and, moreover, can be analog signals, digital signals, or a combination of the two.

The data can be acquired or sampled from the sensor(s) at a relatively high rate, for instance, 200 Hz (i.e., every 0.005 second), as the rotary tricone drill bit 206 rotates and descends through the rock mass. According to one or more embodiments, the sampling frequency can be configurable/reconfigurable according to the application (e.g., 200 Hz or greater or 200 Hz+/−50 Hz). Such sampling frequency may be high enough to prevent or minimize data aliasing. The system 300, via drill system 350, can thus repeatedly acquire machine performance measurements from the sensor(s) of the one or more monitoring or monitorable components 354 of the electric drilling machine 100 as the rotary tricone drill bit 206 descends through the rock mass. Moreover, in that the data from the sensor(s) can be sampled at a relatively high frequency (or frequencies), the data can be provided as raw data with sufficiently high granularity. According to one or more embodiments, the sampling frequency can always be higher than a frequency of the system 300 for making real time adjustments to pulldown pressure/rate and rotary speed of the rotary tricone drill bit 206.

The drill control interface module 330, which may be referred to herein as a real-time control sub-system or drill control interface circuitry, can include an interface system or module 332 and a processor system or module 334. Generally, the drill control interface module 330 can acquire and process inputs (e.g., digital), and, implementing an automatic drill control methodology according to embodiments of the disclosed subject matter, can generate real-time control outputs (e.g., digital) to interfaces and pulldown force and actuators (e.g., rotary actuators) of the drill system 350 while the electric drilling machine 100 is operating. That is, the drill control interface module 330 can leverage the drill system 350, particularly the control module 352 for control and feedback signaling regarding the one or more monitoring or monitorable components 354 in the form of rotary speed, rotary torque (or electric current), hoist/pulldown speed, hoist/pulldown force (or electric current), bit air pressure, penetration rate, horizontal vibration data, and/or vertical vibration data, to implement the automatic drill control methodology. In this regard, automatic drill control methodologies according to embodiments of the disclosed subject matter can be adaptive, using one or more machine learning techniques, for instance, to automatically control applied pulldown pressure/rate and rotary speed via outputs (e.g., digital electrical signals) from the drill control interface module 330 to the drill system 350. Such control can be under variable geological conditions and/or the surrounding environment, and, as such, can selectively apply constraints based on relative closeness of operational parameters to real or perceived operational limits and/or detection of exceptional conditions during the drilling operation caused by the geological conditions and/or the surrounding environment (e.g., changes in temperature, conditions within the blasthole and at the bit/rock interface).

According to one or more embodiments, the drill control interface module 330 can be a hardware platform that implements a Programmable Logic Controller ("PLC") as the interface module 332 and an embedded computer (CPU) as the processor module 334, though embodiments of the disclosed subject matter are not so limited. The drill control interface module 330 can also include signal and power conditioning modules for analog and/or digital inputs from or associated with the one or more monitoring or monitorable components 354 of the electric drilling machine 100, as well as interfaces and outputs for the output of electrical signaling to one or more of the one or more monitoring or monitorable components 354, such as actuator(s) (e.g., electronically controlled), motor(s), and valve(s) associated with operation of the electric drilling machine 100 and/or control module 352 of the drill system 350. As shown in FIG. 3, such control signaling can be provided to the one or more monitoring or monitorable components 354 (e.g., via interface module 332) and/or the control module 352 of the drill system 350.

The drill system 350 can control the drilling operation, for instance, under control of an operator of the electric drilling machine 100. However, upon activation, the drill control interface module 330 can implement an automated drilling control methodology, for instance, via a control algorithm (e.g., software control algorithm) and resulting control logic for real time, to automatically adjust the applied pulldown pressure/force and rotary speed actuators that act on the rotary tricone drill bit 206 of the electric drilling machine 100. At least the actual drilling of the drilling operation can be performed automatically using the automated drilling control methodology of the drill control interface module 330.

According to one or more embodiments, once activated, the automated drilling control methodology can cause and control the automatic execution of some or all activities from the moment the electric drilling machine 100 is leveled over a drilling location, to full cleaning and retraction of the drill string assembly 200 and rotary tricone drill bit 206 after creating a blasthole of a desired target depth. Thus, some or all of the following activities can be automatically performed as part of automated drilling control methodologies according to embodiments of the disclosed subject matter: (1) smoothly lowering the rotary tricone drill bit 206 to make initial contact with the rock mass; (2) collaring the blasthole to a preset depth or until intact rock is detected to minimize vertical hole deviation; (3) drilling the blasthole to the desired target depth, for instance, dictated by a blast design, while also contending (and adjusting applied pulldown pressure/rate and rotatory speed) with specific conditions that may be present due to variable geological conditions (including within the blasthole and at the bit/rock interface); (4) optionally reaming and cleaning the hole; and/or (5) retracting the drill string assembly 200 and rotary tricone drill bit 206 in preparation for unleveling and moving (e.g., to drill another blasthole). According to one or more embodiments, the automated drilling control methodology may be used to perform only the processes associated with operation (3) above.

Regarding operation (3) above, one or more embodiments of the disclosed subject matter can, in order to control pulldown pressure/rate and rotary speed, include manual (e.g., via user interface 312) activation or automatic activation (e.g., responsive to signal(s) from the drill system 350 indicating exceptional conditions and/or part of an automated drilling sequence proceeding from operation (2) above)) of the automatic control methodology via operation of the drill control interface module 330. The required blasthole depth can be provided from the storage 314 of the drill guidance module 310 and used by the processor module 334 of the drill control interface module 330 upon initiation of each instance of the automatic control methodology, including upon initial drilling of the blasthole or in the event that drilling stops and is restarted prior to reaching the required blasthole depth. In such a case, the processor module 334 may store and access the required blasthole depth data once provided from the drill guidance module 310. According to one or more embodiments, an automatic drill mode module 335 can receive and process, and optionally store, the required blasthole depth data. The automatic drill mode module 335 can also receive the activation (or deactivation) command from the drill guidance module 310.

The automatic drill mode module 335 can provide drilling data to the machine control module 336 of the processor module 334. The machine control module 336 can use the drilling data to perform the automatic control of the drilling operation according to embodiments of the disclosed subject matter. Such drilling data can include the blasthole depth data and other drilling-related data, such as historical data from the current blasthole or one or more associated blastholes (e.g., an adjacent blasthole) and/or execution logs of the current blasthole and/or one or more associated blastholes. As shown in FIG. 3, additional drilling-related data can be provided from the historical data module 337 of the processor module 334.

Incidentally, drilling-related data may be updated in the historical data module 337 during the automatic drilling control according to embodiments of the disclosed subject matter. For example, the machine control module 336 of the processor module 334 can supply drilling-related data based on the real-time control operations when performing automatic control of the drilling operation. Optionally, the drilling-related data may pertain to drilling-related data of another electric drilling machine 100, for instance, having the same or substantially the same configuration of rotary tricone drill bit 206. Drilling-related data from the historical data module 337 may form some or all of the basis for artificial intelligence and machine learning aspects of embodiments of the disclosed subject matter for maximizing penetration rate for specific rock mass characterizations as the electric drilling machine 100 drills the blasthole. For instance, the historical data module 337 may have or form a database of knowledge regarding ground characteristics in correspondence with penetration rate or depth of cut and associated setpoints for at least pulldown pressure/rate and rotary speed believed to achieve the penetration rate or depth of cut for the particular type or characterized rock mass. Optionally, additional drilling-related information may be associated with the foregoing information, such as environmental-related information (e.g., temperature, humidity, etc.).

When controlling drilling according to automatic drilling control methodologies according to embodiments of the disclosed subject matter, the drill control interface module 330 can repeatedly acquire MWD performance measurements from one or more sensor(s) of the one or more monitoring or monitorable components 354 of the electric drilling machine 100 at the current depth of drilling. Such signals can be sent directly to the drill control interface module 330 and/or via the control module 352 of the drill system 350. As noted above, the data can be acquired or sampled from the sensor(s) at a relatively high rate, for instance, 200 Hz (i.e., every 0.005 second), as the rotary tricone drill bit 206 rotates and descends through the rock mass. According to one or more embodiments, the sampling frequency can be configurable/reconfigurable according to the particular application (e.g., 200 Hz or greater or 200 Hz+/−50 Hz), via the calibration and configuration module 338 of the processor module 334, for instance. The sampling frequency can, according to one or more embodiments, always be higher than a frequency of the system 300 for making real time adjustments to pulldown pressure/rate and rotary speed of the rotary tricone drill bit 206.

According to one or more embodiments, the drill control interface module 330 can correct the values from the sensor (s) that may be introduced by the drill system 350, and that may need to be offset. Optionally, the offsets can be applied using conversion tables that can be either statically pre-calibrated (e.g., by a maintenance team using scales and an RPM measurement device or devices) or dynamically updated by comparing electronically calculated MWD values versus measured (e.g., displaced over time) equivalent values. Such correction can be performed by the machine control module 336 of the processor module 334.

The drill control interface module 330 can determine whether normal or exceptional drilling conditions are present. Such determination can be made based on feedback from the from one or more sensor(s) of the one or more monitoring or monitorable components 354, for instance, for each depth in the blasthole as the electric drilling machine 100 drills downward to create the blasthole. Generally, automatic drilling control can be performed differently based on whether the drill control interface module 330 identifies normal or exceptional drilling conditions. Normal drilling conditions can mean vibration, rotary motor torque/current, bit air pressure, motor temperature (I2T), etc. all being (or returning) within predetermined respective ranges. On the other hand, exceptional drilling conditions can mean that one or more of the foregoing is outside of the predetermined ranges or even anticipated to be outside of the predetermined ranges. In some cases, the one or more of the vibration, rotary motor torque/current, bit air pressure, motor temperature (I2T), etc. outside the predetermined ranges can constitute exceptional drilling conditions when such parameters are outside the ranges for a predetermined amount of time.

The drill control interface module 330, particularly the machine control module 336, can apply one or more machine learning techniques to acquired MWD performance data from the one or more sensor(s) of the one or more monitoring or monitorable components 354 of the electric drilling machine 100. Such machine learning can be used to improve overall control constraints and/or control responsiveness, particularly in relatively highly variable geological conditions and/or to contend with progressive wear of the rotary tricone drill bit 206 during the drilling operation.

For instance, at a given point in time during the drilling operation the drill control interface module 330 can identify that a suitable depth of cut is a certain value, such as 1.0 cm, based feedback from the one or more sensor(s) and corresponding identification of a type or characterization of the rock mass at the given point in time. Such value of depth of cut may correspond to a setpoint selected from one or more stored setpoint values, for instance, stored in the historical data module 337, in association with respective one or more types or characterizations of the rock mass. The drill control interface module 330 can output control signals to one or more of one or more monitoring or monitorable components 354 (e.g., actuators, motor(s), etc.) to control the rotary tricone drill bit 206 in an effort to maintain the depth of cut at 1.0 cm (or within a predetermined depth of cut range around 1.0 cm).

The drill control interface module 330 can then apply variation to the 1.0 cm knowledge, for instance, one or more variations, such as 9.0 mm and/or 1.1 cm, to control the drilling operation according to each variation, followed by obtaining feedback from one or more sensors(s) of the one or more monitoring or monitorable components 354 regarding drilling performance of the electric drilling machine 100. The feedback can be used to determine specific energy and penetration rate or depth of cut and further analyzed by the drill control interface module 330. The drill control interface module 330, therefore, can use image variables (outputs) in the form of specific energy and penetration rate for the control loop to build knowledge for future drilling operations according to varying conditions whether known or unknown. Depending upon the type of electric drilling machine 100, i.e., all electric motor(s) or not, the penetration rate can be determined based on displacement over time or current consumed by the electric motor(s).

The further analysis can include using the specific energy to characterize the rock mass in correspondence with the penetration rate or depth of cut. The analysis can also include determining whether any of the variations improves upon the knowledge of the drilling control methodology. If so, information corresponding to the variations can be stored as one or more additional depth of cut setpoints, for instance, in the historical data module 337 of the drill control interface module 330, for later retrieval upon identification of rock mass having the same characteristics during future drilling. To be clear, each stored depth of cut setpoint can have associated therewith corresponding setpoint values at which to set the pulldown pressure/rate and the rotary speed of the electric drilling machine 100. Improved knowledge can be in the context of maximizing penetration rate while minimizing rotation speed. Hence, embodiments of the disclosed subject matter can conclude that the variation led to a performance improvement if the penetration rate increases and/or the penetration rate maintains for a lower rotation speed.

When the determined rock mass characterization does not have associated therewith a previously stored penetration rate or depth of cut setpoint, the penetration rate or depth of cut can be interpolated as a value between two adjacent previously stored rates or depths. Pulldown pressure/rate and rotary speed control values can be determined for the interpolated value. The interpolated value, or variations thereof, can be stored in the historical data module 337. Hence, embodiments of the disclosed subject matter may implement or may be characterized as implementing a multi-point learning system.

In that the drill control interface module 330, according to one or more embodiments of the disclosed subject matter, can interface with existing drill guidance module 310 and/or drill system 350 of the electric drilling machine 100, as noted above, drilling control commands can include proportional commands from the machine control module 336 to control both the hoist/pull down force and rotation speed of the rotary tricone drill bit 206 via the drill system 350. The corresponding response of the electric drilling machine 100 can be provided to the drill control interface module 330, particularly the machine control module 336, as feedback for validation and possible adjustment when the value(s) fall outside a predetermined threshold or threshold range.

The control command signaling can involve a so-called translation process to constraints for the pulldown pressure/rate and rotary speed. The constraints may be based on consumable limitations (e.g., rotary tricone drill bit limits for applied pulldown and rotation speed) and/or operator "feel" preferences. Such constraints can be in the context of operation within a predetermined threshold of a maximum value, in an effort to converge to or about to the maximum value.

An underlying concept for one or more embodiments of the disclosed subject matter can be that precise knowledge of the drilling mechanisms operating at the bit-rock interface during drilling may be unknown, or at least inaccurate and varying on a continuous basis due to the inherent geological variability that is present in the blasthole along with other conditions that are present at the bit-rock interface or along the length of the blasthole (e.g., cuttings removal, eccentric drill pipe, frictional effects, etc.). However, the correlation between specific machine performance responses (outputs) for applied inputs for hoist/pulldown force and rotation speed can allow for reasonable presumptions when adjusting inputs in order to obtain specific changes in outputs.

In view of the foregoing, the automated drilling control methodology, according to one or more embodiments of the disclosed subject matter, implemented using the drill control interface 330, for instance, can enhance (e.g., maximize) drilling performance using linear programming optimization over the domain variables (inputs) of the drilling function (i.e., excluding image variables or outputs), particularly where each monitored drilling characteristic value, in its turn, can dynamically get translated into a constraint on the hoist/pull down force or rotary speed command to be applied from the drill control interface module 330, based on a priori knowledge of the drilling. In this translation process, while the transformation rules themselves can be predetermined, in order to account for the unknown variability, the results can be obtained from convergence of approximations rather than fixed mathematical formulae.

At a higher level, the automated drilling control methodology according to one or more embodiments of the disclosed subject matter can enhance (e.g., maximize) rate of penetration while minimizing rotation speed based on optimization of two image variables, i.e., penetration rate and specific energy. At a lower level, after the drill control interface module 330 transforms image variable constraints into domain variable constraints, the drill control interface module 330 can independently enhance (e.g., maximize) pulldown force and rotation speed, wherein each these two parameters may be subject to one or more constraining upper bounds. When certain conditions are detected by the system 300 not to be present, such as undesirable vibration, torque, and/or rotary tricone drill bit air pressure (e.g., outside certain thresholds), the limiting constraints over the pulldown and rotation commands can be defined by the drill control interface module 330 according to the actual penetration rate and past observations under similar drilling conditions. Such constraints can be selectively provided by the calibration and configuration module 338 or the control module 352 of the drill system 350, depending upon whether the certain conditions (i.e., exceptional conditions) are underway or not, respectively.

INDUSTRIAL APPLICABILITY

As noted above, embodiments of the present disclosure relate to automated control of an electrically powered blasthole drill, such as electric drilling machine 100, based on performance monitoring of the electric drilling 100 when drilling a vertical blasthole in a geological rock mass.

According to one or more embodiments, the system, apparatus, and/or method can be computer-based and operational to automatically and precisely (e.g., within a predefined adjustment setting) adjust and control the electric drilling machine 100 in real time, for instance, when geological variations encountered at the bit-rock interface in the blasthole result in one or more changes to state and/or performance of the electric drilling machine 100. The system, apparatus, and/or method can implement adaptive control theory and machine learning techniques as applied to a range of time-series data feedback acquired from one or more sensors of the electric drilling machine 100 that monitor physical performance variables of the drilling electric drilling machine 100 during drilling, such as current (in the case of the electric drilling machine 100 with only electric motor(s)), voltage(s) (in the case of the electric drilling machine 100 with only electric motor(s)), pressure, and/or displacement of the drill string assembly 200 and a rotary tricone bit 206, during a drilling operation of the drilling electric drilling machine 100.

The variability of human machine operation can be reduced or eliminated by embodiments of the disclosed subject matter based on the adaptive control of the drilling operation of the electric drilling machine 100 so as to quickly, consistently, and automatically adjust the applied pulldown pressure/rate and rotary speed toward maximizing overall electric drilling machine 100 performance and minimizing wear/tear on the electric drilling machine 100 (including the drill string assembly 200 and/or the rotary tricone drill bit 206), for instance, while drilling vertical or substantially vertical blastholes while operating in relatively variable geological conditions. Generally, time-series data acquired in real time from monitoring performance data of the electric drilling machine 100 during drilling can form some or all of the basis for subsequently determining the need to invoke suitable automated drilling machine control according to embodiments of the disclosed subject matter. Hence, embodiments of the disclosed subject matter can provide or implement a drilling control system, method, and/or apparatus for electric drilling machines, such as electric drilling machine 100, that can automatically and continuously seek to maximize, in real time, the effective penetration rate for the drilling operation, while also minimizing consumable and machine wear/tear for the particular geological conditions being encountered during the drilling operation. In this regard, embodiments of the disclosed subject matter can control pulldown pressure/rate and rotary speed so as to try to maintain a given Depth of Cut ("DoC") with the assumption that an optimum DoC is unknown and the control continuously explores to improve upon the DoC in an effort to attain the optimum DoC.

According to one or more embodiments, systems, methods, and/or apparatuses can automatically detect in real-time the presence of normal or exceptional drilling conditions in a blasthole while drilling with relatively little or no a-priori information. Such systems, methods, and/or apparatuses can utilize available performance feedback information acquired from one or more sensors on or associated with operation of the electric drilling machine 200 to make automatic adjustments to pulldown pressure/rate and rotary speed. In the context of an electrically powered drilling machine, i.e., a drilling machine with (or with only) one or more electric motors to drive the drill string assembly 200 and rotary tricone drill bit 206, such sensors can provide current and/or voltage associated with operation of the electric motor(s) during the drilling operation. On the other hand, embodiments of the disclosed subject matter are not limited to only electric drilling machines, and may include hybrid electric drilling machines with at least one electric motor and another means by which to rotate the drill string assembly 200 and rotary tricone drill bit 206. Hence, signals from the sensor(s) of the electric drilling machine 100 can additionally or alternatively include pressure and/or displacement of the rotary tricone drill bit 206 during the drilling operation of the electric drilling machine 100. Characteristics of the rotary tricone drill bit 206 can also be taken into consideration.

The automated drilling control methodology, particularly implementing the drill control module 330, can constantly (e.g., continuously or within a predefined control period) seek to achieve a maximum effective penetration rate obtainable for the existing geological conditions that are present in a blasthole while also minimizing consumable and electric drilling machine 100 wear and tear. As a result, the automated drilling control methodology according to one or more embodiments of the disclosed subject matter can prevent or minimize undesirable (e.g., above a certain threshold) vibrations, rotary tricone drill bit 206 plugging (based on monitored air pressure and excessive applied pulldown pressures for the geological conditions that are present), and undesirable (e.g., above a certain threshold) torque in the motor(s) that generate drill string rotation (also due to excessive applied pulldown pressures for the geological conditions that may be present or when a failing or failed rotary tricone drill bit 206 is present). According to one or more embodiments, the automated drilling control methodology can prevent or minimize heat buildup ($I^2T$) in one or more electric motors that generate the drill string assembly 200 rotation, in the case of the electric drilling machine 100 having one or more electric motors to rotate the drill string assembly 200 and thus the rotary tricone drill bit 206.

The execution of the automated drilling control methodology for the drilling of a blasthole can be fully automated in whole or in part and may not require direct monitoring or supervision by a human operator to operate. In addition, the control sequence does not need to be activated from the start of initial drilling of the blasthole, but rather can be used to also enable automated drilling of partially completed holes or resuming halted sequences due to an interruption to the actual machine operation (e.g., for operator breaks or delays in the mining process).

The automated drilling control methodology according to embodiments of the disclosed subject matter, particularly implementing the drill control module 330, can also effectively deal with degrading operational conditions that may commonly occur, such as, drill string assembly 200 and rotary tricone drill bit 206 jamming that results from the collapse of blasthole walls (due to the presence of poor geological conditions combined with excessive rotation speeds) and reflected in increased motor torque and lateral vibrations.

Regarding the foregoing effects, the automated drilling control methodology can control vibration through the constraint of rotational speed of the drill string assembly 200 and rotary tricone drill bit 206, penetration rate can be controlled through constraining the pulldown force, torque and bit pressure can be controlled through constraining the pulldown force, for instance, eventually up to the point of inverting the direction of the thrust, and heat induction in the motor(s) can be controlled through constraining the related command.

An underlying concept for one or more embodiments of the disclosed subject matter can be that precise knowledge of the drilling mechanisms operating at the bit-rock interface may be unknown, or at least inaccurate and varying on a continuous basis due to the inherent geological variability and efficiency of the removal of cuttings at the bit-rock interface that is present. However, the correlation between specific machine performance responses (outputs) for applied inputs for hoist/pulldown force and rotation speed allows for reasonable presumptions when adjusting inputs in order to obtain specific changes in outputs.

In view of the foregoing, the automated drilling control methodology, according to one or more embodiments of the disclosed subject matter, can allow drilling performance to be maximized using linear programming optimization over the domain variables (inputs) of the drilling function (i.e., excluding image variables or outputs), particularly where each monitored drilling characteristic value, in its turn, dynamically gets translated into a constraint on the hoist/pull down force or rotary speed command to be applied, based on a priori knowledge of the drilling. In this translation process, while the transformation rules themselves can be predetermined, in order to account for the unknown variability, the results can be obtained from convergence of approximations rather than fixed mathematical formulae.

At a higher level, the automated drilling control methodology according to one or more embodiments of the disclosed subject matter can maximize rate of penetration while minimizing rotation speed based on optimization of two image variables, i.e., penetration rate and specific energy. At a lower level, after transformation of image variable constraints into domain variable constraints, the automated drilling control methodology can independently maximize pulldown force and rotation speed, where each these two parameters may be subject to one or more constraining upper bounds. When certain conditions are detected not to be present, such as undesirable vibration, torque, and/or bit air pressure (e.g., outside certain thresholds), the limiting constraints over the pulldown and rotation commands can be defined by the actual penetration rate and past observations under similar drilling conditions.

As noted above, in practice, rock breakage using rotary tricone drill bit, such as rotary tricone drill bit 206, can be far from steady-state due to the multivariate and dynamic processes that are in fact occurring at the bit-rock interface. Hence, automated drilling control methodologies according to embodiments of the disclosed subject matter can be based on the assumption that the Depth of Cut ("DoC") is an unknown parameter upfront, where its value can be iteratively determined, adjusted, and improved over time through real-time sampling and machine learning, i.e., based on a trial and error approach using the drill control interface module 330.

Automated drilling control methodologies according to embodiments of the disclosed subject matter can also be adaptive and use continuous machine learning techniques to compensate for performance fluctuations ranging from progressive changes, for example, motor and bit wear and seasonal (e.g., temperature induced) effects, to sudden (e.g., transient) situations, for example, significant geological transitions (e.g., hard to soft, soft to hard), conditions at the bit-rock interface and along the blasthole (e.g., frictional effects, cuttings removal, etc.), or machine component (e.g., motor) repairs and replacement.

When exceptional drilling conditions are detected based on monitored feedback from the drill system 350, the related control constraints for these can be applied and override the primary constraints that are used for "normal" drilling. These constraints can continue to regulate the machine performance until the drill control interface module 330, based on the feedback, determines that the exceptional conditions are no longer are present. For exceptional condition handling, the constraint values can be determined using closed-loop feedback with predefined settling time and separate threshold points for progressive activation and deactivation of the constraint such that oscillation and/or unproductive overreaction can be minimized or prevented. Optionally, a third threshold point can be used to trigger the handling of catastrophic situations and abort uncontrollable options that, if not addressed, could induce significant damage to the electric drilling machine 100. While the drill control interface module 330 can be configured to prevent or minimize such behavior, according to one or more embodiments the drill control interface module 330 can provide such feature as a further fail-safe mechanism. These threshold points are either configured based on the specific machine capability, for instance, via the calibration and configuration module 338, or, in some cases, learned by the drill control interface module 330, for instance, based on monitoring of manual operation of the electric drilling machine 100.

According to one or more embodiments, automated drilling control methodologies can correct MWD values obtained from monitoring blasthole drills due to systemic errors that may be introduced by the drill system 350 and that need to be offset. Such offsets can include be applied using, for instance, conversion tables that are either statically pre-calibrated (by a maintenance team using scales and RPM measurement devices) or dynamically updated by comparing electrically calculated MWD values (versus measured (e.g., displacement over time) equivalent values).

Figure 4:
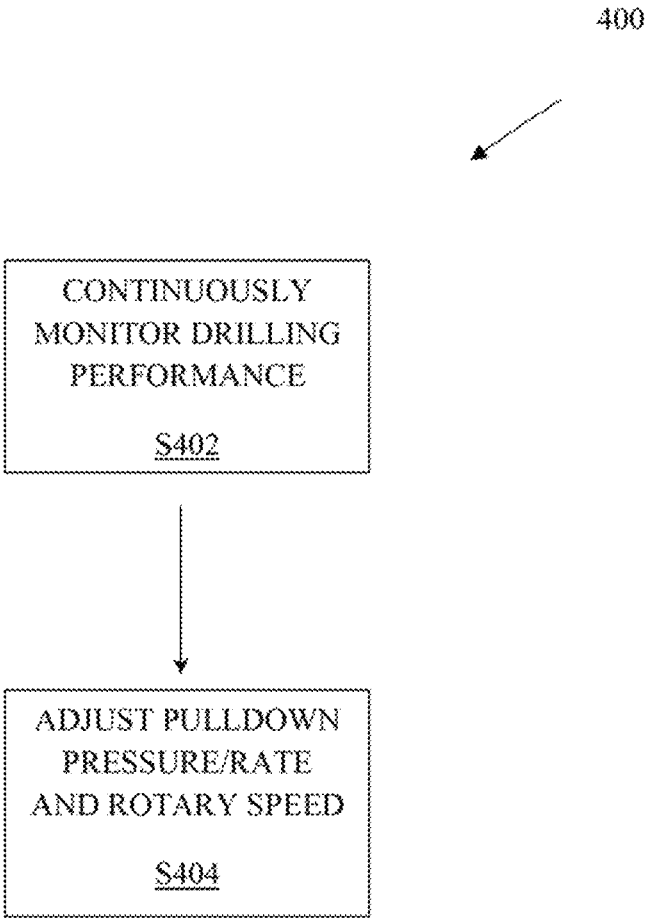
FIG. 4 is a flow chart of a method according to one or more embodiments of the disclosed subject matter.

FIG. 4 is a flow diagram of a method 400 according to embodiments of the disclosed subject matter.

Generally, the method 400, which can be implemented using system 300 can involve continuously monitoring drilling performance of an electric drilling machine, such as electric drilling machine 100 at operation S402, and adjusting pulldown pressure/rate and rotary speed of a rotary tricone drill bit, such as rotary tricone drill bit 206, of the electric drilling machine 100 based on the drill performance data from the monitoring of the drilling performance at operation S404. Operation S402 and operation S404 can be performed in real time. The drilling performance data can be used to determine feedback in the form of specific energy and penetration rate or depth of cut. Moreover, the feedback can be used to characterize the rock mass at the sampling interval. Such characterization can be used to identify current setpoints for setting and controlling the pulldown pressure/rate and rotary speed to achieve and maintain a same depth of cut for the characterized rock mass. The rock mass characterization can also be used to build a knowledge database of such setpoints, which may include one or more interpolated setups determined by the learning process. Hence, the operation S404 can optimize the penetration rate by controlling (e.g., adjusting) the pulldown pressure/rate and rotary speed based on each identified rock mass type or rock mass characterization encountered during the drilling operation.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. An advanced real-time drilling control system comprising:

a real-time control sub-system including an embedded computing platform, programmable logic controller, and embedded software, the real-time control sub-system being configured to:

continuously monitor, in real time, drilling performance of an electric drilling machine as the electric drilling machine drills a blasthole using a rotary tricone drill bit, the continuously monitoring including continuously collecting, according to a predetermined sampling rate, drill performance data from one or more sensors of the electric drilling machine in real time, and adjust, in real time, at least one of pulldown pressure and pulldown rate, as well as rotary speed of the rotary tricone drill bit of the electric drilling machine to optimize penetration rate of the rotary tricone drill bit based on the drill performance data and output of one or more machine learning operations applied to the drill performance data, wherein the real-time control sub-system is configured to characterize a rock mass during the drilling operation based on specific energy determined from the drill performance data collected from the one or more sensors of the electric drilling machine, and wherein the adjustment of the at least one of the pulldown pressure and the pulldown rate, as well as the rotary speed of the rotary tricone drill bit to optimize the penetration rate of the rotary tricone drill bit is specific to the characterized rock mass.

2. The advanced real-time drilling control system of claim 1, wherein additional information and inputs of geological conditions in an area being drilled, characteristics of the rotary tricone drill bit, and/or specific electric drilling machine parameters are leveraged to refine capabilities and the responsiveness of the drilling control system to perform the adjustment of the at least one of the pulldown pressure and the pulldown rate, as well as the rotary speed of the rotary tricone drill bit.

3. The advanced real-time drilling control system of claim 1, wherein digital outputs are provided in real time from the real-time control sub-system to automatically adjust respective electronic actuators of the electric drilling machine associated with the at least one of the pulldown pressure and the pulldown rate, as well as the rotary speed under both normal and exceptional drilling conditions.

4. The advanced real-time drilling control system of claim 1, wherein the output of the one or more machine learning operations consists of a specific energy value and a penetration rate value associated with the penetration rate.

5. The advanced real-time drilling control system of claim 1, wherein the adjustment of the at least one of the pulldown pressure and the pulldown rate, as well as the rotary speed of the rotary tricone drill bit to optimize the penetration rate of the rotary tricone drill bit, is based on one or more previously defined setpoints for a particular penetration rate-rock mass characterization combination stored in memory of the real-time control sub-system and identification of current rock mass characterization by the real-time control sub-system based on the drill performance data collected in real time.

6. The advanced real-time drilling control system of claim 1, wherein the adjustment of the at least one of the pulldown pressure and the pulldown rate, as well as the rotary speed of the rotary tricone drill bit to optimize the penetration rate of the rotary tricone drill bit is performed relative to an interpolated penetration rate and corresponding interpolated at least one pulldown pressure and pulldown rate, as well as rotary speed values.

7. The advanced real-time drilling control system of claim 1, wherein the real-time control sub-system is configured to measure the penetration rate in real time, and wherein the adjustment of the at least one of the pulldown pressure and the pulldown rate, as well as the rotary speed of the rotary tricone drill bit to optimize the penetration rate of the rotary tricone drill bit is performed based on the measured penetration rate.

8. The advanced real-time drilling control system of claim 7, wherein the penetration rate is measured based on current consumed by one or more electric motors of the electric drilling machine.

9. An automatic drilling control method comprising:

receiving, in real time, at drill control interface circuitry, monitor-while-drilling (MWD) signals from one or more sensors of an electric drilling machine at a predetermined sampling rate as the electric drilling machine drills a blasthole;

determining, using the drill control interface circuitry, a rock mass characterization of a rock mass at varying depths in the blasthole as the electric drilling machine drills the blasthole based on determination of specific energy using the monitor-while-drilling (MWD) signals from the one or more sensors of the electric drilling machine; and maintaining, using the drill control interface circuitry, penetration rate of a rotary tricone drill bit of the electric drilling machine to within a predetermined optimization range specific to the rock mass with the determined rock mass characterizations for each of a plurality of varying depth as the electric drilling machine drills the blasthole, said maintaining the penetration rate including controlling, in real time, at least one of pulldown pressure and pulldown rate, as well as rotary speed of the rotary tricone drill bit based on processing of the monitor-while-drilling, (MWD) signals from one or more sensors of the electric drilling machine, wherein the sampling rate for the monitor-while-drilling (MWD) signals is greater than a rate to control the at least one of the pulldown pressure and the pulldown rate, as well as the rotary speed of the rotary tricone drill bit in real time.

10. The automatic drilling control method according to claim 9, further comprising:

determining, using the drill control interface circuitry, for each of the determined rock mass characterizations, whether the determined rock mass characterization has associated therewith a previously stored penetration rate and the corresponding at least one of a pulldown pressure control value and a pulldown rate control value, as well as a rotary speed control value stored in memory of the drill control interface circuitry;

when the determined rock mass characterization has associated therewith the previously stored penetration rate and corresponding pulldown pressure/rate and rotary speed control values, setting, using the drill control interface circuitry, the penetration rate to the previously stored penetration rate and using the corresponding at least one of the pulldown pressure control value and the pulldown rate control value, as well as the rotary speed control value stored in the memory for performing said maintaining the penetration rate of the rotary tricone drill bit of the electric drilling machine to within the predetermined optimization range; and when the determined rock mass characterization does not have associated therewith the previously stored penetration rate and the corresponding pulldown pressure control value and the pulldown rate control value, as well as the rotary speed control value, setting, using the drill control interface circuitry, the penetration rate to an interpolated value between two adjacent previously stored penetration rates and the corresponding at least one of the pulldown pressure control value and the pulldown rate control value, as well as the rotary speed control value associated with the interpolated value, for performing said maintaining the penetration rate of the rotary tricone drill bit of the electric drilling machine to within the predetermined optimization range.

11. The automatic drilling control method according to claim 9, further comprising measuring, using the drill control interface circuitry, in real time, the penetration rate as the electric drilling machine drills the blasthole, wherein said maintaining the penetration rate of the rotary tricone drill bit to within the predetermined optimization range specific to the determined rock mass characterization is performed using the measured penetration rate and the specific energy as feedback.

12. The automatic drilling control method according to claim 11, wherein the penetration rate is determined exclusively based on current consumed by one or more electric motors of the electric drilling machine.

13. The automatic drilling control method according to claim 9, wherein said maintaining the penetration rate of the rotary tricone drill bit to within the predetermined optimization range specific to the determined rock mass characterization includes:

changing the penetration rate one or more times within the predetermined optimization range, and recording, in memory of the drill control interface circuitry, set points for the at least one of the pulldown pressure and the pulldown rate, as well as the rotary speed control values for each of the one or more changed penetration rates, in association with the corresponding determined rock mass characterizations based on feedback in the form of the specific energy determined from the drilling operation.

14. A non-transitory computer-readable storage medium having stored thereon instructions that, when executed by one or more processors, causes the one or more processors to perform a drilling control method comprising:

receiving, in real time, monitor-while-drilling (MWD) signals from one or more sensors of an electric drilling machine at a predetermined sampling rate as the electric drilling machine drills a blasthole;

determining penetration rate based on measured current consumed by one or more electric motors of the electric drilling machine; and maintaining penetration rate of a rotary tricone drill bit of the electric drilling machine to within a predetermined optimization range specific to a rock mass characterization of a rock mass at varying depths in the blasthole as the electric drilling machine drills the blasthole, said maintaining the penetration rate including controlling, in real time, at least one of pulldown pressure and pulldown rate, as well as rotary speed of the rotary tricone drill bit based on processing of the monitor-while-drilling (MWD) signals from one or more sensors, wherein the sampling rate for the monitor-while-drilling (MWD) signals is greater than a rate to control the at least one of the pulldown pressure and the pulldown rate, as well as the rotary speed of the rotary tricone drill bit in real time, and wherein said maintaining the penetration rate of the rotary tricone drill bit includes using the determined penetration rate as feedback.

15. The non-transitory computer-readable storage medium according to claim 14, wherein the drilling control method further comprises:

determining each said rock mass characterization at varying depths in the rock mass as the electric drilling machine drills the blasthole;

determining whether the determined rock mass characterization has associated therewith a previously stored penetration rate and a corresponding at least one of a pulldown pressure control value and a pulldown rate control value, as well as a rotary speed control value;

when the determined rock mass characterization has associated therewith the previously stored penetration rate and a corresponding stored at least one of a setpoint pulldown pressure control value and setpoint pulldown rate control value, as well as a setpoint rotary speed control value, setting, using the drill control interface circuitry, the penetration rate to the previously stored penetration rate and using the corresponding stored at least one of the setpoint pulldown pressure rate and pressure control value and the setpoint pulldown rate control value, as well as the setpoint rotary speed control value to perform said maintaining the penetration rate of the rotary tricone drill bit of the electric drilling machine to within the predetermined optimization range; and when the determined rock mass characterization does not have associated therewith the previously stored penetration rate and the corresponding stored at least one of the setpoint pulldown pressure control value and the setpoint pulldown rate control value, as well as the setpoint rotary speed control value, setting the penetration rate to an interpolated value between two adjacent previously stored penetration rates and using the corresponding at least one of the pulldown pressure control value and the pulldown rate control value, as well as the rotary speed control value associated with the interpolated value to perform said maintaining the penetration rate of the rotary tricone drill bit of the electric drilling machine to within the predetermined optimization range.

16. The non-transitory computer-readable storage medium according to claim 14, wherein the drilling control method further comprises measuring, in real time, the penetration rate as the electric drilling machine drills the blasthole, and wherein said maintaining the penetration rate of the rotary tricone drill bit to within the predetermined optimization range specific to the rock mass characterization is performed using the measured penetration rate and a specific energy value as feedback.

17. The non-transitory computer-readable storage medium according to claim 14, wherein said maintaining the penetration rate of the rotary tricone drill bit to within the predetermined optimization range specific to the rock mass characterization includes:

changing the penetration rate one or more times within the predetermined optimization range, and determining whether to save set points for at least the at least one of the pulldown pressure and the pulldown rate, as well as the rotary speed control values for each of the one or more changed penetration rates, in association with the corresponding rock mass characterizations based on feedback in the form of the specific energy determined from the drilling operation.

* * * * *